US007330123B1

(12) United States Patent
Grahn et al.

(10) Patent No.: US 7,330,123 B1
(45) Date of Patent: Feb. 12, 2008

(54) SONAR BASED DROWNING MONITOR

(75) Inventors: Dennis A. Grahn, Palo Alto, CA (US); H. Craig Heller, Stanford, CA (US); Robert M. Sapolsky, San Francisco, CA (US); Lisa Share, San Francisco, CA (US)

(73) Assignee: Stanford University-Office of Technology Licensing, Palo Alto, CA (US)

( * ) Notice: Subject to any disclaimer, the term of this patent is extended or adjusted under 35 U.S.C. 154(b) by 577 days.

(21) Appl. No.: 10/865,127

(22) Filed: Jun. 9, 2004

Related U.S. Application Data

(60) Provisional application No. 60/477,188, filed on Jun. 9, 2003.

(51) Int. Cl.
*G08B 23/00* (2006.01)

(52) U.S. Cl. ..... 340/573.6; 340/573.1; 340/553; 367/134

(58) Field of Classification Search ..... 340/573.6, 340/553, 573.1, 552, 522, 540, 541; 367/134, 367/93, 94
See application file for complete search history.

(56) References Cited

U.S. PATENT DOCUMENTS

| | | | | |
|---|---|---|---|---|
| 4,932,009 | A | 6/1990 | Lynch | |
| 5,043,705 | A | 8/1991 | Rooz et al. | |
| 5,369,623 | A * | 11/1994 | Zerangue | 367/93 |
| 5,638,048 | A * | 6/1997 | Curry | 340/552 |
| 5,959,534 | A * | 9/1999 | Campbell et al. | 340/573.6 |
| 6,133,838 | A * | 10/2000 | Meniere | 340/573.6 |
| 6,327,220 | B1 * | 12/2001 | Miller et al. | 367/134 |

OTHER PUBLICATIONS

U.S. Appl. No. 10/258,528, filed Aug. 7, 2003, Brussiuex et al.

* cited by examiner

*Primary Examiner*—Anh V. La
(74) *Attorney, Agent, or Firm*—Fernandez & Associates, LLP

(57) ABSTRACT

Low-cost, reliable, easy to use device and method identifies potential drowning or near-drowning events (i.e. a submerged inert human) in a timely manner, provides the precise location of the event, and issues an alert that such an event is in progress. Device is optionally networked to remote monitoring station.

24 Claims, 6 Drawing Sheets

FIG. 5

Analysis algorithm:

scan- generate pixel map
subtract background
fix target positions
rescan generate pixel map
fix target positions
compare target positions
rescan, fix, compare
repeat on infinite loop
If target remains stationary for X seconds code green
If target remains motionless for Y seconds code yellow
If target remains motionless for Z seconds code red and sound alarm.

SONAR BASED DROWNING MONITOR

RELATED APPLICATIONS

This application claims priority to provisional application Ser. No. 60/477,188, filed Jun. 9, 2003, the benefit of the filing date of which is hereby claimed under 35 U.S.C. §119(e).

FIELD OF INVENTION

Invention relates generally to the field of drowning monitoring, and more specifically to a device and method for sonar based drowning monitoring.

BACKGROUND OF INVENTION

Drowning is the second leading cause of injury-related deaths for children ages 1 to 14. For example, in 1998, more than 1,300 children and young people (ages 0-18) died from drowning. For every child who drowns, another four are hospitalized and 16 receive emergency department care for near-drowning. Among children ages 1 to 4, most drownings occur in residential swimming pools. Most children who drowned in pools were last seen in the home, had been out of sight less than five minutes, and were in the care of one or both parents at the time. Pool fencing is not enough to prevent drowning among young children. In a Center for Disease Control (CDC) funded study, researchers estimated that proper pool fencing would have prevented about one-fifth of drownings among children under 5. This finding suggests that additional strategies (e.g. pool covers, alarms, community education) are needed to prevent drowning (CDC Injury fact book 2001-2002 Water-Related Injuries).

The probability that a near drowning victim will survive decreases significantly with the duration of his submersion. For example, some statistics indicate that a swimmer rescued after only one minute of submersion has a 98 percent probability of surviving while submersion for five minutes or more reduces the survival probability to 25 percent. Even survivors of near drownings may suffer permanent brain damage from extended submersion.

Several solutions have been proposed for detecting drowning events. Approaches include sensors that attach to each individual in the water, wave detectors that detect an object entering the water when the pool is unoccupied but must be inactivated during pool use, and complex video monitoring systems. These solutions have shortcomings such as being impractical, inappropriate for monitoring ordinary swimming episodes, or cost prohibitive. Detecting drowning events by sonar imaging of swimming pools has also been proposed. However, sonar systems are typically quite expensive and therefore unlikely to be widely adopted. Moreover, they focus on monitoring only the top or bottom layers of a swimming pool, thus potentially delaying detection of drowning events during a period critical for the victim. In additions, these systems can be largely inoperative in crowded swimming pools, and they are not adaptable for use in other bodies of water such as lakes.

A current need remains for tools to aid in saving drowning victims. The tools should be inexpensive for widespread adoption and maximum impact. The tools should be detecting drowning events quite promptly. Also helpful would be any means of pinpointing the location of a distressed swimmer in a large or crowded body of water. Such tools should pose a minimum of inconvenience to swimmers. Finally, drowning monitoring systems should be operative under a broad range of conditions, thus ensuring their maximum effectiveness.

SUMMARY OF INVENTION

The present invention relates to systems, kits, methods, and computer programs for monitoring water related activities for detecting persons in danger of drowning. The invention is useful for monitoring any body of water, such as a swimming pool.

Sonar transducers for obtaining sonar images are employed in monitoring. Preferably, images of substantial vertical sections of the monitored body of water are collected. In some embodiments, a broad-swath sonar transducer is employed. In some embodiments a plurality of sonar transducers are used. The transducers repeatedly collect images of the water they monitor, thus generating series of successive images. In some embodiments sonar bar codes are attached to persons in the water, which provide distinctive sonar signatures present in the images obtained from sonar transducers.

The images generated are communicated to a computer. A computer program then analyzes the images to discern a potential drowning event. From the images received the program detects or extracts the position, such as posture and/or location, of persons in the water. The program detects contours of human bodies. Cranial structures and air sacks are particularly useful features for detecting a person's position in a sonar image, as are sonar bar codes when used. In some embodiments, images of the same body of water obtained with different transducers are integrated for detecting a person's position.

Position information extracted from images is compared to corresponding position image in previous images. Thus, a person's position from a current image can be compared to the corresponding position from a defined number of preceding images, which may be collected at fixed time intervals. The purpose of the comparison is to establish if a potential drowning event is in progress. A potential drowning event may be indicated by stillness of a submerged person's body over a defined period of time. Also, prolonged low volume of air sacks may provide an additional or alternative indication of a drowning event, whether in conjunction with stillness or preceding it. Low air sacks volume can be indicated by a low air sacks to cranial structure ratio.

If the computer program detects a potential drowning event, it issues an alarm. The alarm can be communicated in many ways to potential rescuers or other interested parties. In one embodiment, the system has an interface compatible for communicating the alarm to a building automation system. A building automation system can direct the alarm promptly to many interested persons or entities.

Some embodiments utilize an imaging station capable to indicate the location in the body of water of a potential drowning event. Another feature may be a passive mode of operation, which automatically switches to an active mode when activity in the swimming pool is sensed.

The invention is relatively inexpensive and reliable, and therefore may become widely adopted, thus resulting in a significant reduction of the severity of near drowning consequences and the number of drowning fatalities.

BRIEF DESCRIPTION OF DRAWINGS

FIG. 5 illustrates an example algorithm for detecting an inactive individual, according to an embodiment of the present invention.

DETAILED DESCRIPTION OF PREFERRED EMBODIMENTS

Technology is provided for monitoring bodies of water to detect persons in danger of drowning. The technology may be embodied in many forms, such as systems comprising sonar detectors and computers, software, kits, methods of analyzing sonar images, and methods of making drowning monitors. Present invention uses one or more transducers to monitor and track human activity in the water, uses an algorithm to detect an individual at risk of drowning, and uses an alarm to announce that there is a person in danger of drowning in the water. Optionally, invention comprises an imaging and/or monitoring station, a target locating capacity, and/or external communications capacity.

Sonar transducers for obtaining sonar images are employed. Generally, a sonar transducer is an active device that emits a beam in the form of a succession of pulses and detects the echo of the pulses caused by their reflection from an obstacle in the path of the beam. Sonar detection of underwater objects is a mature technology. Existing sonar devices can be used for drowning detection monitors. For example, fish finders currently on the market often have the adequate capacity to detect and monitor the underwater activity of a large group of humans in a relatively small swimming facility. Preferably, a broad-swath sonar transducer is used to obtain images of substantial vertical sections of the monitored body of water. By broad-swath is meant a type of sonar imaging device or array that covers a volume of water larger than an essentially planar slice or an essentially linear path. For example, Lowrance Electronics Inc. (Tulsa, Okla.) manufactures and incorporates into Eagle® Trifinder (a fish finder device) a sonar transducer of sufficient complexity for many embodiments of the present invention. In some embodiments a plurality of sonar transducers are used in monitoring a specific body of water.

Figure 1:
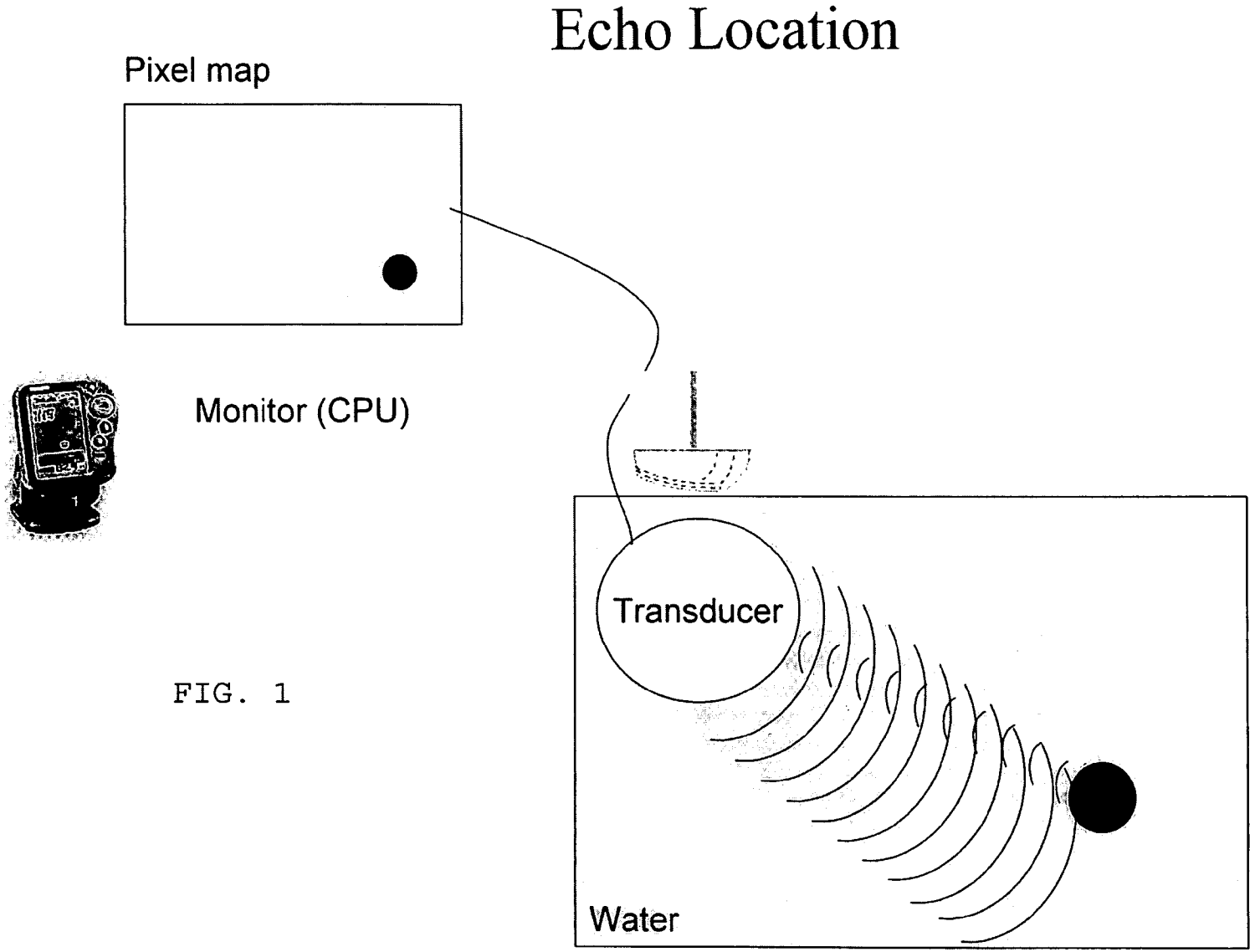
FIG. 1 is a diagram illustrating a transducer and a solid in a body of water, and a corresponding pixel map generated according to an embodiment of the present invention.
Figure 2:
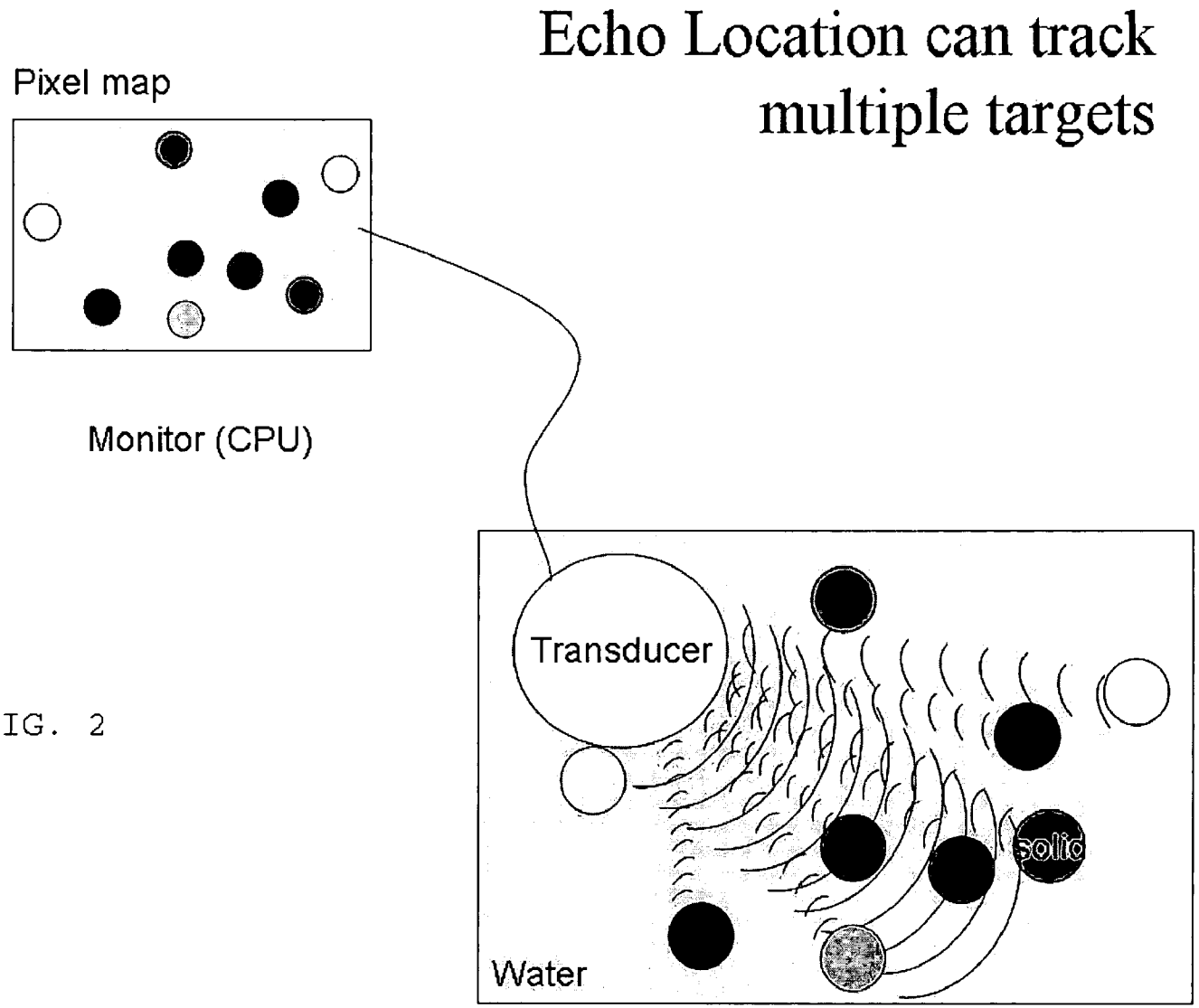
FIG. 2 is a diagram illustrating a transducer and multiple solids in a body of water, and a corresponding pixel map generated according to an embodiment of the present invention.
Figure 3:
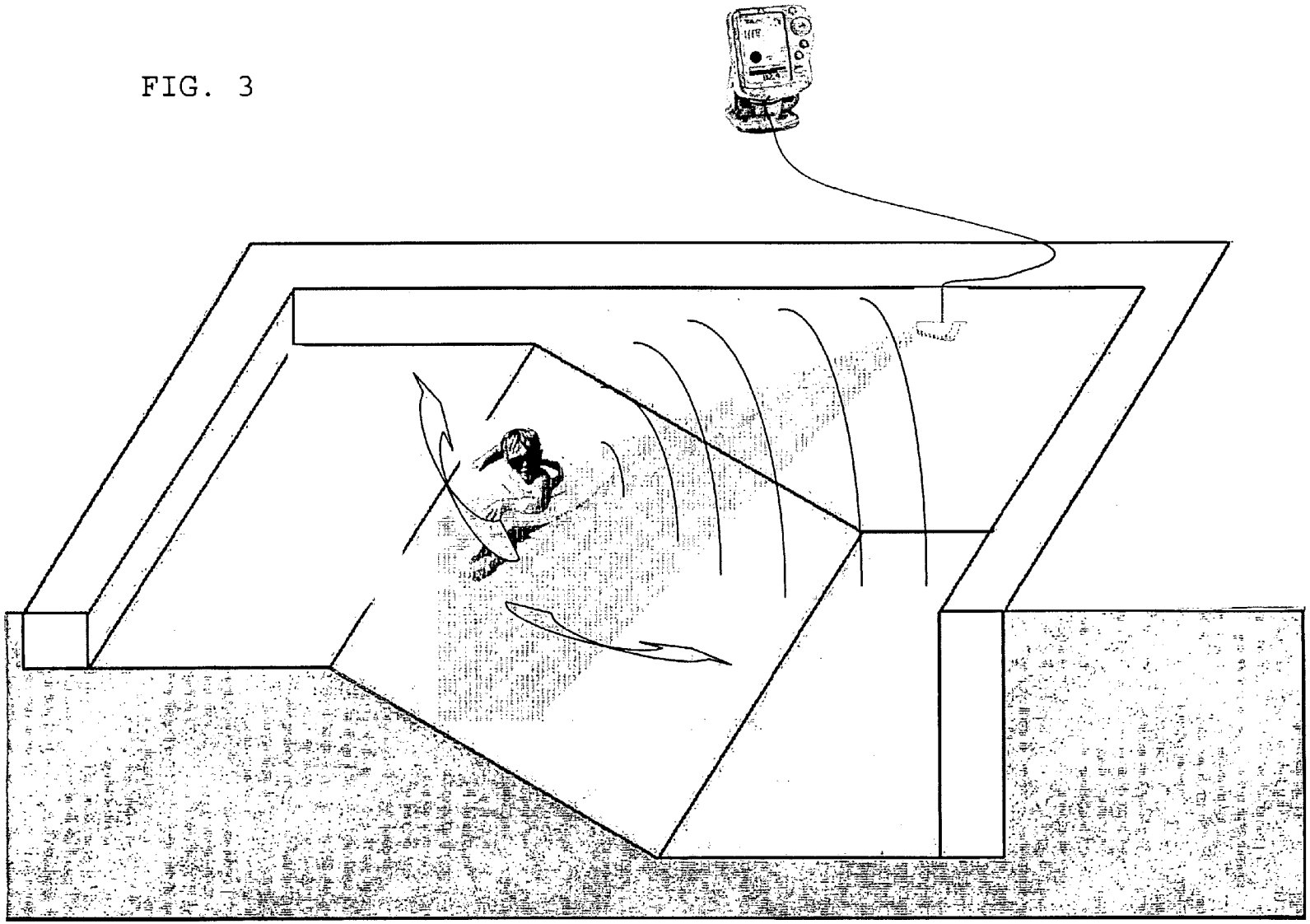
FIG. 3 is a diagram illustrating a scanning directional sonar detecting a child in a body of water, according to an embodiment of the present invention.
Figure 4:
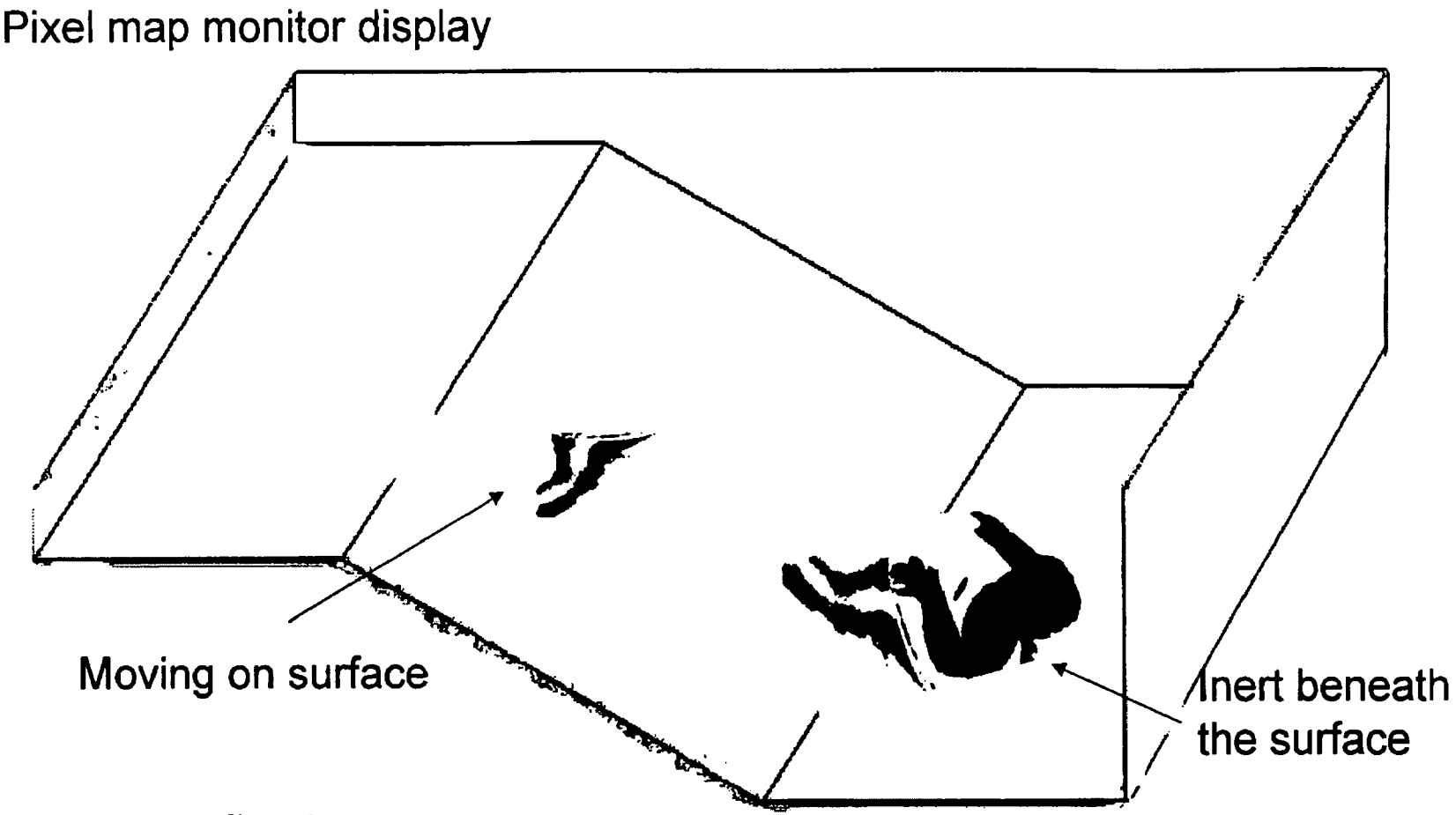
FIG. 4 is a diagram illustrating an example pixel map display, according to an embodiment of the present invention.

A sonar transducer generates an image of the body of water being monitored. For example, an image (pixel map) corresponding to a solid in a body of water as detected by a transducer is illustrated in FIG. 1. FIG. 2 illustrates a pixel map of multiple solids in a body of water as obtained with a transducer. The adaptation of sonar imaging to monitoring a swimming pool is illustrated in FIG. 3 and FIG. 4. A scanning directional sonar is used in FIG. 3 for high resolution echo detection. FIG. 4 illustrates a pixel map monitor display according to an embodiment of the invention showing a collected image of a swimming pool. The image obtained with the sonar transducer is transmitted to one or more computers.

The drowning monitor is powered by a power source, such as a power supply (for example a 110 volt power supply) or a set of rechargeable batteries for the transducer and/or CPU and/or monitor. Optionally, drowning monitor is coupled to a telemetry link, such as a battery operated transducer with a telemetry link to the CPU and/or monitor providing a telemetry link between, for example, a poolside battery-operated monitor and a remote CPU.

In operation a sonar transducer will repeatedly collect images of the water they monitor, and convey these to the computer. Thus, transducers generate a series of successive images. Images are typically acquired at predetermined intervals of time so that the time interval from one frame to the successive frame is known, and thus may be used in calculating duration of events as explained below.

Images transmitted to the computer are analyzed. A purpose of the analysis is to identify persons in the image at risk of drowning. This identification may be based at least in part on the recognition of a cranial structure in the image, i.e. under the surface of the water. Echo detection from air sacks may also be useful in identifying persons at risk, especially when combined with corresponding cranial structures. Other information can be extracted from pixel maps regarding persons at risk of drowning, such as body posture and/or site within the water. In some embodiments where persons in the water have sonar bar codes attached, sonar bar code information is also extracted from pixel maps. Information regarding each person in an image may be called target position.

A time series analysis of pixel maps allows tracking of potential drowning events. Thus, an algorithm specific for the task of discriminating active people from the potential drowning victims is employed. In a preferred embodiment the algorithm focuses on the stillness of potential drowning victim. Thus, a person that is submerged and inert for a defined period of time, for example 30 seconds, may be considered at risk of drowning. Another feature useful in identifying potential drowning victims is the sonar image corresponding to sacks in lungs. Air filled lungs produce a substantial sonar echo. A decrease in this signal from a submerged person may indicate a potential drowning victim. This information may be used in conjunction with an ensuing stillness of the potential drowning victim. In addition, the ratio of signals from air sacks to cranial structures or other indicators of body size can provide an indication of a drowning event because a very low ratio may be caused by water in the lungs. Thus, look up tables may be provided to indicate the minimum acceptable ratio. A person determined to be below the minimum value may be indicated as a potential drowning victim even before corresponding body stillness is detected.

Figure 6:
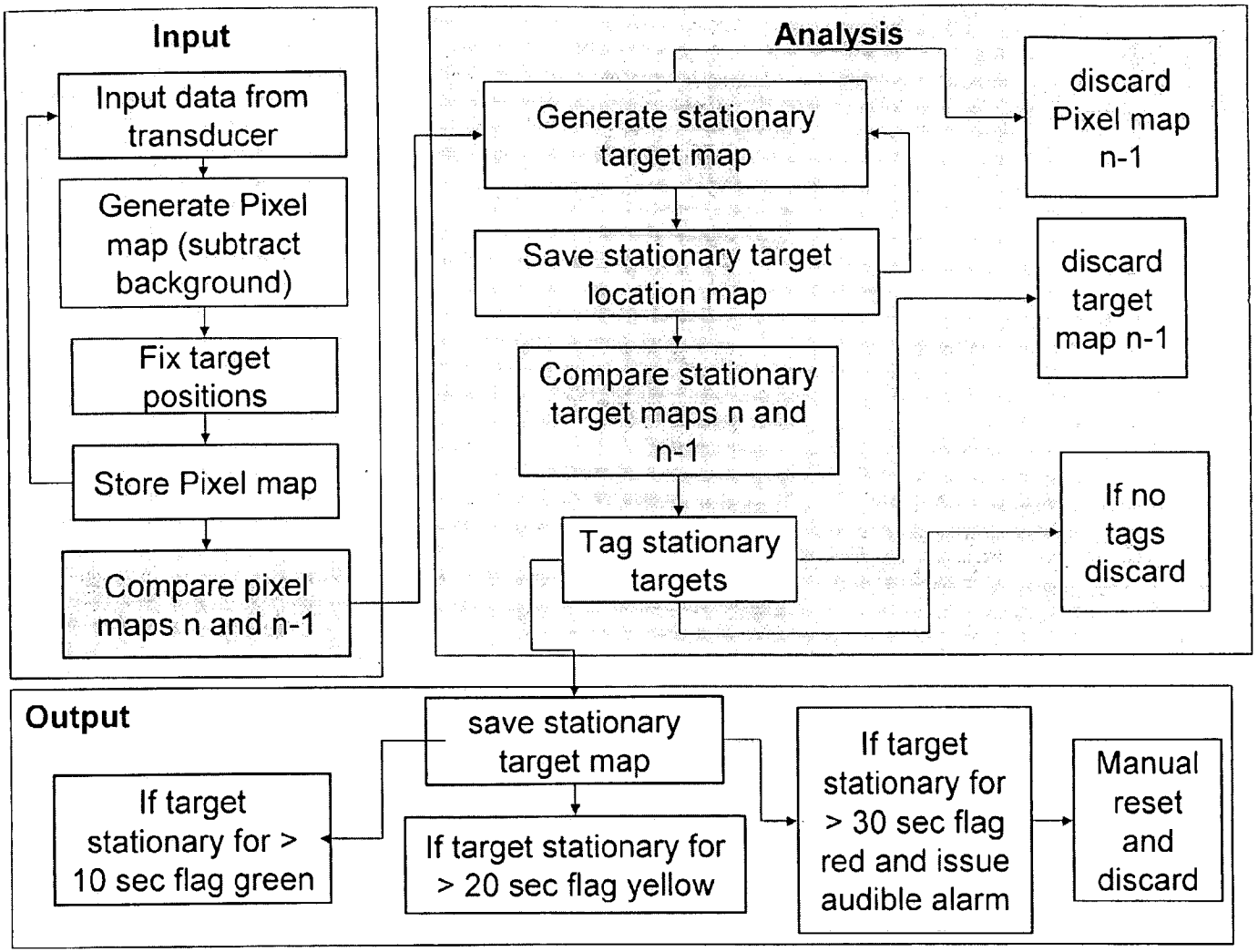
FIG. 6 is a flow diagram illustrating a method for sonar based drowning monitor, according to an embodiment of the present invention.

An algorithm for detecting a potential drowning victim as a motionless individual from a series of sonar images is shown in FIG. 5. Accordingly, an image or pixel map of the body of water being monitored is collected. Any background, such as signals expected from the walls of a swimming pool, is subtracted. Target positions, i.e. information regarding persons at risk of drowning, are then determined for that image. A subsequent image is then generated and target positions are extracted again. Target positions from the two pixel maps are compared. The steps of pixel map generation, fixing target positions, and comparing is repeated indefinitely. If a target is determined to have remained stationary for a predefined period of time, this event is brought to the attention of a supervisor of the drowning monitor. Different warning levels may be issued depending on the amount of time a target has remained motionless. Any useful amount of time may be selected to trigger a warning level. A method of detecting a motionless individual as a potential drowning victim is depicted in FIG. 6.

For monitoring a small swimming pool of simple geometry and typically used by a limited number of persons, a single sonar transducer may be sufficient. In some embodiments the drowning monitor employs multiple sonar grids. In crowed waters, individual swimmers can be hidden in the sonar shadows of other bathers if a single sonar transducer is used. These sonar shadows can be virtually eliminated using multiple sonar transducers positioned strategically around a pool, for example by employing a triangulation grid map, where two or more transducers, each operating at a different frequency, scan the water. The sonar images received by individual transducers are analyzed separately so that each produces an icon map of the individuals in the water and identifies potential subjects at risk. The input from the various transducers is integrated to produce a coherent report on the human activities in the pool and the risk status of the people in the water. This input integration is easier the further down the analysis chain it takes place. As one example, only sonar images identified as risks may be incorporated into the final integration of the sonar display.

Sonar "bar codes" can be attached to individual swimmers, which would aid in the functioning of the drowning monitor. Sonar bar codes are devices that reflect a unique sonar image can be attached to each individual in the pool. This approach is similar to locker keys which are pinned in the bathing suits, except in this case the sonar bar codes would each reflect a unique sonar image. Bar codes can help for example in the analysis of a series of pixel maps, or of images obtained with different transducers.

If the computer program detects a potential drowning event, it issues an alarm. The alarm signal can be communicated in many ways to potential rescuers. It may comprise a sound alarm and/or one or more emergency warning lights that go on at the pool or water site and/or remote locations. It may be shown on a screen display as described below. In one embodiment, the system has an interface compatible for communicating the alarm to a remote location, such as via a building automation system. A building automation system can direct the alarm promptly to many interested persons or entities.

Alarm signals or any self-diagnosis information as described below from a drowning monitor may be communicated by any known feasible means. As such, signals are communicated through wired or wireless connections. Examples of wired connections include twisted pair, coaxial, power lines, or fiber optic cables. Examples of wireless connections include radio frequency (RF), infrared (IR) communication means. For example, in some embodiments transmitter communicates via an RF link to an RF link network. Signals are typically communicated via a communication interface over a network or system that may be a computer data network or a control network, such as a building automation network. There are many examples of systems in which drowning monitors may be integrated. One such system is the CEBus system, which has been made an EIA standard, known as the EIA 600 standard, which was originally developed by Intellon Corp. A second system is the LonWorks system commercially available from and developed by Echelon Corp, San Jose, Calif. While the drowning monitors may be adapted to communicate by a variety of means, it is preferable that they communicate to a local operating network using a standard protocol, such as the BACnet (ISO standard 16484-5) protocol or the LonTalk® (also known as the ANSI/EIA 709.1 Control Networking Standard) protocol, CEBus, X10 or CAN. In response to a drowning alarm, a system may convey the emergency message to those who need to intervene, but may also actuate automatic responses such as draining a swimming pool or triggering other automatic emergency responses.

Other embodiments can be adapted to suit the needs and arrangements of any of various users of a drowning monitor. As drowning is a rare occurrence that takes place at random, the end users of the drowning monitor would be anyone that provides access to, and/or assumes responsibility for, facilities designed for water immersion activities. These facilities include swimming and wading pools, hot tubs, spas, lakes, and other similar water immersion activity sites. The drowning monitor need not be stationary, i.e. it may be portable or installed on a boat. Examples of end users are homeowners, communities, and businesses (such as hotels, apartment complexes, and other business entities that provide access to a body of water). The monitor of the water activities may be a lifeguard or other responsible poolside adult, but the system could easily be designed for remote monitoring. For instance, the monitoring and alarm system could be set up at the front desk clerk of a hotel, at the lifeguard station or main office, or in the kitchen of a residence (for example inside the house). The drowning monitor could be networked to a remote monitoring organization such as a security company, a community center, a fire department, a police station for after-hours monitoring, a business' front desk or a business' security office. Typically, a drowning alarm would be present at the pool site regardless of where the monitoring station is set up and whether the drowning monitor communicates over a network with external entities.

Some embodiments comprise an imaging station capable of indicating the location in the body of water of a potential drowning event. Thus, a display screen may indicate one or more sonar images, or may show integrated image information. The imaging station may comprise a "target locator feature", wherein a screen image of the water is displayed pinpointing the precise location of a subject identified as being at risk. Optionally, the system comprises a video display of target positions wherein specific targets are color-coded or otherwise visually identified. For example, if stillness is the basis of drowning detection, if target remains stationary for X seconds it is color-coded green, if target remains motionless for Y seconds it is color-code yellow, and if target remains motionless for Z seconds it is color-code red, wherein $X<y<Z$ are chosen to be on the order of a few seconds and to ensure optimal safety and/or performance and/or allow meaningful reaction time for a user of the system.

Optionally, drowning monitor comprises two modes of operation. A first mode is an active mode in which drowning monitor watches over the activities of everyone in the water. A second mode is a passive mode, wherein drowning monitor senses for the presence of activity in the water. Activity may be sensed via sonar imaging or via any other suitable sensor. When activity is detected in the water, the device switches from the passive to active mode, optionally triggering an alarm indicating such change in operational mode.

If the drowning monitor is purchased by an end user in a one time sale transaction, then failsafe indicators should be manufactured into the device to alert the end user should the drowning monitor ever become non-functional, especially if it is used in a home pool application where there is no lifeguard. System failure can be caused by a malfunction at any point in the system including: power failure, sonar transducer malfunction, changes in pool water level that strand the transducer above the water level, interruptions of communication between the transducer and the Central Processing Unit (CPU), and CPU signal integration error. The device is designed to monitor activity in the water and thus the failsafe indicator should be related to that function. For instance, the walls of the pool should be a fixed constant; a loss of that fixed point icon or a change in the image of the pool walls would indicate that the system is not working properly. Such a change in the system output should be tied to a system malfunction-alerting signal. This failsafe indicator system can be part of a trouble shooting or self-diagnostics system that also determines the source of the failure. Optionally, such a drowning monitor might be offered by a business to an end user on a subscription basis, covering routine compliance checks and/or remote monitoring services.

The invention provides several advantages compared to current related technologies, although all advantages are not necessarily present in every embodiment of the invention. The disclosed invention in most embodiments is relatively inexpensive, and therefore may become widely embraced. Consequently, swimming and water related activities should become considerably safer. Detection of distress is made quickly, thus not only enabling a prompt response to the emergency but also minimizing the potential for brain damage that accompanies near drowning episodes. In many embodiments the precise location of a drowning person is pinpointed ensuring the fastest intervention. This feature can be especially valuable in large or crowded areas. In some embodiments, alarm signals are communicated instantaneously to many rescue teams, such as lifeguards and paramedics, minimizing any delay that might result from the necessity of human involvement. Many embodiments do not require any effort or precaution, or cause only negligible inconvenience to swimmers. Many embodiments are effective under a broad range of conditions, ensuring a virtually failsafe system. Widespread adoption of the invention will result in numerous lives being saved.

All cited documents, including patents, patent applications, and other publications are incorporated herein by reference in their entirety.

Foregoing described embodiments of the invention are provided as illustrations and descriptions. They are not intended to limit the invention to the precise form described. Other variations and embodiments are possible in light of above teachings, and it is thus intended that the scope of invention not be limited by this Detailed Description, but rather by the following claims.

What is claimed is:

1. A system for detecting a drowning person within a body of water, the system comprising:

at least one broad-swath sonar transducer for repeatedly collecting an image of the body of water, a computer for receiving the image, an image analysis computer program for detecting a position of one or more persons, wherein the sonar transducer collects successive images at fixed time intervals, the computer program compares the position of one or more persons in successive images, and the computer program issues an alarm when the position of at least one human body in successive images indicates a potential drowning event; wherein the image analysis computer program detects the position of one or more persons by identifying cranial structures.

2. The system according to claim 1 wherein the image analysis computer program detects the position one or more persons by identifying air sacks.

3. The system according to claim 1 wherein the potential drowning event is indicated by stillness.

4. The system according to claim 2 wherein the potential drowning event is indicated by a low air sacks to cranial structure ratio.

5. The system according to claim 1 wherein the body of water is a swimming pool.

6. A kit comprising a sonar bar code suitable for attachment to a person and a system according to claim 1, wherein the image analysis computer program detects the position one or more persons by locating the bar code.

7. A system for detecting a drowning person within a swimming pool, the system comprising:

a sonar bar code attached to at least one person in the swimming pool, a plurality of sonar transducers for repeatedly collecting images of the swimming pool, a computer for receiving the images, an image analysis computer program for detecting a position of one or more persons within the images, wherein each of the plurality of sonar transducers collects successive images at fixed time intervals, the computer program compares the position of one or more persons in successive images, and the computer program issues an alarm when the position of at least one person in successive images indicates a potential drowning event.

8. The system according to claim 7 further comprising an imaging station capable to indicate the location in the swimming pool of the potential drowning event.

9. The system according to claim 7 wherein the computer program detects the position of one or more persons within the images by integrating images from different transducers.

10. The system according to claim 7, the system being capable of operation in a passive and an active mode, and switching from the passive to the active mode being triggered by activity in the swimming pool.

11. The system according to claim 7 wherein the alarm is communicated to a building automation system.

12. A method of detecting drowning events within a body of water, the method comprising:

obtaining successive sonar-generated images of a substantial vertical section of the body of water, extracting from each image a position of a person, comparing the position to corresponding positions in a defined number of preceding images, issuing an alarm when the comparison indicates a potential drowning event; wherein extracting comprises identifying a cranial structure in the image.

13. The method according to claim 12 wherein the body of water is a swimming pool.

14. The method according to claim 12 further comprising communicating the alarm to a building automation system.

15. The method according to claim 12 wherein the potential drowning event is indicated by stillness.

16. The method according to claim 12 wherein the potential drowning event is indicated by a low air sacks to cranial structure ratio.

17. The method according to claim 12 further comprising attaching a sonar bar code to the person, and wherein extracting comprises identifying the bar code in the image.

18. Software for detecting drowning events, the software embodied on at least one computer readable medium and operable when executed by at least one processor to perform the method according to claim 12.

19. A method of making a device for monitoring drowning within a body of water, the method comprising:

providing at least one broad-swath sonar transducer for generating images, providing a computer coupled to the sonar for receiving the images, providing a computer program for extracting from the images a position of a person, comparing the position to a corresponding position from previous images, issuing an alarm when comparing indicates a potential drowning event; wherein extracting comprises identifying a cranial structure in the image.

20. The method according to claim 19 wherein the potential drowning event is indicated by stillness.

21. The method according to claim 19 further comprising providing an interface for communicating the alarm to a building automation system.

22. A method of making a device for monitoring drowning in a swimming pool, the method comprising:

providing a plurality of sonar transducers for generating images of the swimming pool, providing a computer coupled to the sonar for receiving the images, providing a computer program for integrating images from different sonar transducers, extracting from the integrated images a position of a person, comparing the position to a corresponding position from previous images, issuing an alarm when comparing indicates a potential drowning event; wherein extracting comprises identifying a cranial structure in the image.

23. The method according to claim 22 further comprising providing an imaging station capable to indicate the location in the swimming pool of the potential drowning event.

24. The method of claim 22 further comprising providing a monitoring device capable of operation in a passive and an active mode, and switching from the passive to the active mode being triggered by activity in the swimming pool.

* * * * *